US007188619B2

(12) United States Patent
Bollmers et al.

(10) Patent No.: US 7,188,619 B2
(45) Date of Patent: Mar. 13, 2007

(54) HOUSEHOLD FOOD WARMER

(75) Inventors: Wolfgang Bollmers, Oelde (DE); Michael Empting, Oelde (DE); Johannes Renne, Ennigerloh (DE); Peter Stemig, Lippstadt (DE); Hartmut Wemhoener, Kirchlengern (DE)

(73) Assignee: Miele & Cie. KG, Guetersloh (DE)

( * ) Notice: Subject to any disclaimer, the term of this patent is extended or adjusted under 35 U.S.C. 154(b) by 59 days.

(21) Appl. No.: 10/739,702

(22) Filed: Dec. 18, 2003

(65) Prior Publication Data

US 2004/0169035 A1 Sep. 2, 2004

(30) Foreign Application Priority Data

Dec. 19, 2002 (DE) ..... 102 60 017
Dec. 19, 2002 (DE) ..... 102 60 022

(51) Int. Cl.
*F24C 15/02* (2006.01)
*F24C 15/19* (2006.01)

(52) U.S. Cl. ..... 126/340; 126/198; 126/273 R; 312/330.1

(58) Field of Classification Search ..... 126/190, 126/198, 192, 337 R, 339, 340, 273 R, 275 R, 126/275 E, 19 R, 21 R; 219/520, 522; 312/403, 312/404, 330.1; 62/382
See application file for complete search history.

(56) References Cited

U.S. PATENT DOCUMENTS 1,392,129 A * 9/1921 England ..... 126/275 R
2,214,425 A * 9/1940 McNamara ..... 126/20.2
3,396,717 A * 8/1968 Winkler et al. ..... 126/200
3,720,196 A * 3/1973 Barnett et al. ..... 126/197
3,760,792 A * 9/1973 White ..... 126/198
4,149,518 A * 4/1979 Schmidt et al. ..... 126/190
4,366,687 A * 1/1983 Atkinson ..... 70/71
4,745,775 A * 5/1988 Bussan et al.
4,782,971 A * 11/1988 Hill ..... 220/3.2
5,040,856 A * 8/1991 Wilkins et al. ..... 312/402
5,432,321 A 7/1995 Gerl ..... 219/506
6,166,353 A * 12/2000 Senneville et al. ..... 126/275 E
6,191,391 B1 2/2001 Deo et al. ..... 219/407

FOREIGN PATENT DOCUMENTS

DE 4237570 5/1994
EP 0 443 329 A2 * 8/1991

OTHER PUBLICATIONS

Dacor Warming Oven Use & Care Manual, Dacor Customer Service, 950 South Raymond Avenue, Pasadena, CA 91105, S. Michael Joseph and Anthony B. Joseph.

(Continued)

*Primary Examiner*—Josiah C. Cocks
(74) *Attorney, Agent, or Firm*—Darby & Darby

(57) ABSTRACT

A household food warmer includes a housing and a drawer. The drawer, which can be inserted into the interior chamber of the housing, has a drawer bottom and a front wall with a first opening. The front wall is provided with a sliding device that has a handle, and that engages in a guide formed at the front wall with a guide means, and with which the first opening can be closed in a substantially airtight manner.

11 Claims, 3 Drawing Sheets

OTHER PUBLICATIONS

Dacor Use & Care Manual for Epicure Warming Ovens 24, 27, and 30 inch, Model Nos. EDW024, EDW027, and EDW030, Part No. 85397 9812, Dacor Customer Service, 950 South Raymond Avenue, Pasadena, CA 91105.

Thermador, Warming Drawer Installation Instructions, Model WD24 / WD27 / WD30, 1998, Thermador Corporation, 5551 McFadden Avenue, Huntington Beach, CA 92649.

Thermador Warming Drawer Care & Use Manual, Model WD24, WD27 and WD30, 1998, Thermador Corporation, 5551 McFadden Avenue, Huntington Beach, CA 92649.

Miele, Gerätebeschreibung (Appliance Description), Built-in Dishwarmer, Model Nr. 05 375 530.

* cited by examiner

HOUSEHOLD FOOD WARMER

Priority is claimed to German patent applications DE 102 60 022.8 and DE 102 60 017.1, and the subject matters of both are hereby incorporated by reference herein.

The present invention relates generally to household food warmers, and in particular to a household food warmer including a housing and a drawer, the drawer having a front wall with a sliding device.

BACKGROUND

Household food warmers having a housing and a drawer are generally known and offered by different manufacturers. For example, the Thermador Company of Huntington Beach, USA, distributes such a household food warmer under the name "WD30". The known household food warmer includes a housing, and a drawer which can be inserted into the interior chamber of the housing. Even when the drawer is fully inserted, it is possible to establish a flow connection between the interior chamber of the known household food warmer and the environment. For this purpose, the drawer has a drawer bottom and a front wall; a sliding device designed as an elongated perforated metal plate being arranged at the front wall. A metal angle to which is secured a handle is riveted to the sliding device; the handle protruding through an opening in the front wall, and allowing the user to move the sliding device. The metal plate has side walls at its long edges; the side walls, together with the metal plate, forming a guide means. Located at the front wall is a guide, which is formed of two angles extending parallel to each other, and in which engages the guide means. The angles are fixedly connected to the front wall, also by means of a riveted joint. A plurality of first openings are provided in the front wall between the angles that extend parallel to each other. The sliding device can be moved back and forth along the guide between an open position, in which the openings in the front wall and the openings in the metal plate coincide, and a closed position, in which the openings in the front wall are closed by the metal plate in a substantially airtight manner.

Moreover, a household food warmer which is located under a range is known from U.S. Pat. No. 6,191,391 B1. This household food warmer has a seal which prevents the heated air from escaping from the household food warmer into the environment when the drawer of the household food warmer is fully inserted into the housing. Furthermore, to be able to supply supplementary combustion air from the environment to a gas cooktop of the range, slotted openings are provided on the housing; the sealing being arranged on the housing of the household food warmer and cooperating with the front wall of the drawer in such a manner that the supplementary combustion air can be drawn in from the environment in an unhindered manner.

SUMMARY OF THE INVENTION

Thus, it is an object of the present invention to provide a household food warmer in which the flow connection is provided in a simple manner.

The present invention provides a household food warmer including a housing and a drawer. The drawer can be inserted into the interior chamber of the housing, and has a drawer bottom and a front wall with a first opening. The front wall is provided with a sliding device which has a handle, and which engages in a guide formed at the front wall with a guide means, and with which the first opening can be closed in a substantially airtight manner. The sliding device is formed in one piece.

In addition to a simpler and therefore more cost-effective apparatus, a particular advantage that can be achieved with the present invention is that the apparatus is more rugged and thus less prone to failure. Due to the fact that a one-piece sliding device is used, and because of the associated reduction in assembly steps, the throughput time of the household food warmer according to the present invention is reduced as well.

In an advantageous embodiment of the teaching of the present invention, provision is made for the sliding device to be designed as a plastic part because the shape of plastic parts can be selected within wide suitable limits.

In a further advantageous embodiment, it is proposed that the guide is designed as a longitudinal groove or longitudinal slot, and that the guide means is designed as a first projection. Due to this, the guidance of the sliding device is accomplished in a simple and therefore inexpensive manner.

In an advantageous embodiment of the aforementioned embodiment, it is proposed that the guide, which is formed as a longitudinal slot, at the same time constitutes the first opening. Thus, production is further simplified.

In another advantageous embodiment of the teaching according to the present invention, provision is made for at least one outer wall to be arranged at the front wall; a second opening being formed in the outer wall, and the sliding device being located between the front wall and at least one outer wall that runs essentially parallel to and at a distance from the front wall, and a flow path formed between the first and second openings being able to be closed by the sliding device in a substantially airtight manner. This allows the household food warmer according to the present invention to be designed in a visually advantageous manner.

In the aforementioned embodiment, the space bounded by the front wall and the outer wall may be divided by a partition into a first region and a second region in a substantially tight manner, the flow path being located in the first region. In this manner, it is ensured that the water vapor released by the food placed in the interior chamber is discharged into the open environment, preventing it from accumulating as condensate in the space between the front wall and the outer wall.

In the aforementioned embodiment, the handle of the sliding device may protrude through a third opening in the front wall, and that the third opening is located in a part of the front wall adjacent to the first region. This eliminates the need to seal the free cross-section of the third opening.

The sliding device can, in principle, be selected according to material and shape within wide suitable limits. Conveniently, the sliding device is designed as a plate and provided with a second projection which extends transversely to a moving direction of the plate, and with which the first opening, and thus the flow path formed between the first and second openings, can be closed in a substantially airtight manner.

In a further embodiment of the teaching of the present invention, it is proposed that a spring means is arranged on the sliding device, the spring means running transversely to the plane of motion of the sliding device. This ensures reliable guidance of the sliding device. Moreover, a substantially airtight closure of the first opening, and thus of the flow path formed between the first and second openings, is achieved in a structurally simple manner.

Furthermore, in the aforementioned embodiment, provision may be made for the spring means to be designed as a tongue protruding from the plate. In this manner, the spring means is accomplished in a particularly simple manner, reducing the number of components.

BRIEF DESCRIPTION OF THE DRAWINGS

An exemplary embodiment of the present invention is shown in the drawings in a schematic way and will be described in more detail below.

DETAILED DESCRIPTION

Figure 1:
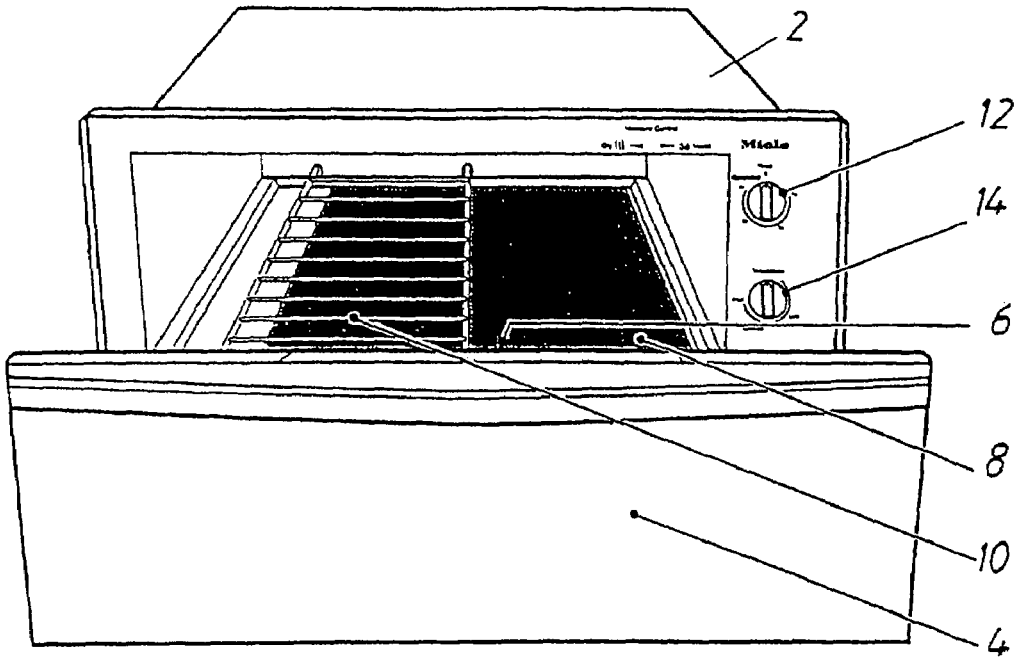
FIG. 1 is a perspective view of an exemplary embodiment of a household food warmer according to the present invention.

FIG. 1 shows a household food warmer according to the present invention for keeping foods and beverages warm. The household food warmer has a housing 2, and a drawer 4, which can be inserted into and held on housing 2. In FIG. 1, drawer 4 is only partially inserted into housing 2. A drawer bottom has a storage area 6 to accommodate foods placed on plates and beverages filled in drinking vessels. In this exemplary embodiment, the plates and drinking vessels can be placed on top side 8 of the drawer bottom. Alternatively or additionally, a rack 10, on which plates and drinking vessels may be placed, can be arranged in storage area 6.

A time selector 12 for setting the keep-warm time and a temperature selector 14 for setting the setpoint temperature for the interior chamber are arranged on housing 2.

Figure 2:
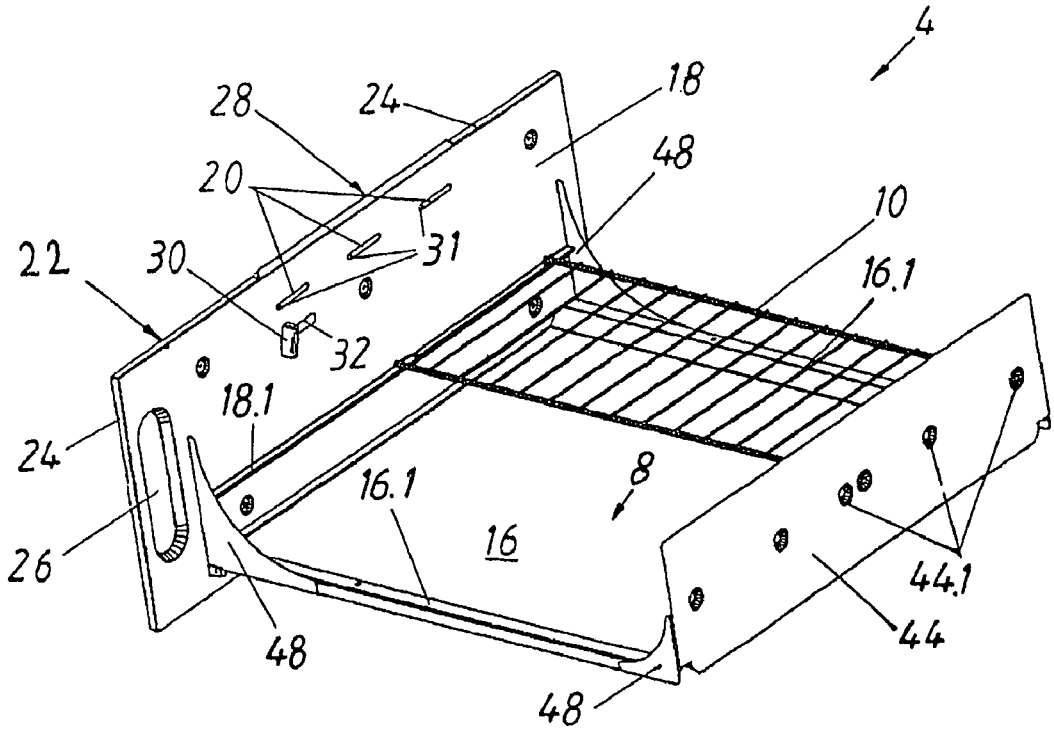
FIG. 2 shows the drawer of the household food warmer of FIG. 1 in a perspective view, looking to the front wall.

FIG. 2 shows drawer 4 of the household food warmer according to the present invention. Drawer 4 has a drawer bottom 16 and a front wall 18; front wall 18 having first openings 20 formed therein. Arranged at front wall 18 is a first outer wall 22 that runs essentially parallel to and at a distance from front wall 18. The gap formed between front wall 18 and first outer wall 22 is bounded by a peripheral, second outer wall 24. Opening 26, which is formed by deep drawing front wall 18, is necessary to allow drawer 4 to be fully inserted into the interior chamber of housing 2 in spite of the time and temperature selectors 12, 14 arranged on housing 2. Second outer wall 24 has formed therein a second opening 28; a flow path (not shown) connecting second opening 28 to first opening 20. In the present exemplary embodiment, front wall 18 and first as well as second outer walls 22 and 24 are made from a single piece of sheet metal. However, other suitable manufacturing methods known to one skilled in the art are conceivable as well, such as using separate metal sheets for front wall 18 and first and second walls 22, 24, and joining them together. In this exemplary embodiment, a glass plate (not shown) is arranged on the side of first outer wall 22 facing the open environment for decorative reasons. Located in the space formed by front wall 18 and outer walls 22 and 24 is a sliding device, of which FIG. 2 shows only handle 30 and guide means 31, which are formed as first projections; handle 30 protruding through a third opening 32 formed in front wall 18, and guide means 31 engaging in first openings 20. In this exemplary embodiment, first openings 20, which are formed as longitudinal slots, are at the same time guides for guide means 31. The sliding device can be moved back and forth between an open position and a closed position. In the open position, the flow path between first openings 20 and second opening 28 is essentially not blocked so that air can be exchanged between the open environment and the interior chamber, which is substantially closed by the fully inserted drawer 4. In the closed position, the flow path is substantially closed so that the above-described air exchange is not possible. In the aforementioned exemplary embodiment, the interstitial space is divided by a partition (not shown) into a first region and a second region in a substantially tight manner, the sliding device and the flow path being located in the first region. The sliding device will be explained in more detail with reference to FIGS. 3 through 5.

Figure 3:
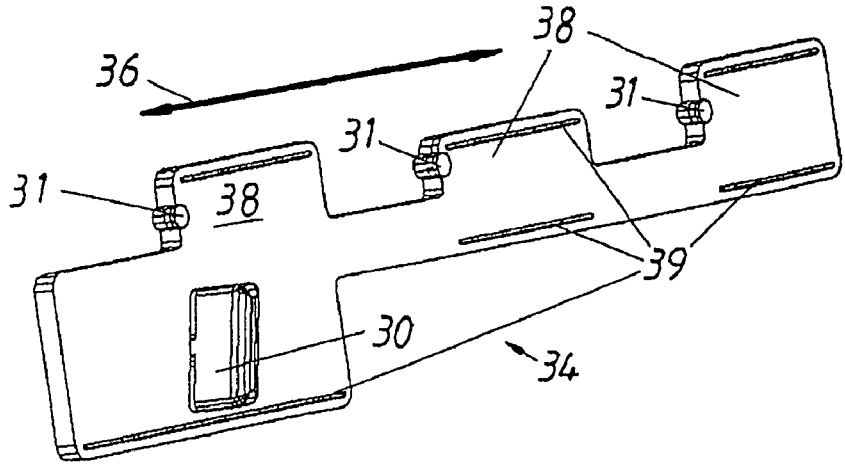
FIG. 3 shows the sliding device of the household food warmer of FIG. 1 in a perspective view, looking to the handle.

In FIG. 3, sliding device 34, which is designed as plastic part, of the household food warmer according to the present invention is shown in a view looking to handle 30. As can be inferred from FIGS. 3 through 5, sliding device 34 is formed in one piece. The moving direction of sliding device 34 is symbolized by a double arrow 36. In this exemplary embodiment, sliding device 34 is designed as a plate and provided with second projections 38 which extend transversely to the moving direction of the plate, and which close the flow path between first openings 20 and second opening 28 in a substantially airtight manner when sliding device 34 is in the closed position. Handle 30 is formed on sliding device 34 at an offset from second projections 38 with respect to the moving direction of sliding device 34, i.e., at a downward offset in the image plane of FIG. 3, and extending transversely from the plane of motion of the sliding device. Also formed on sliding device 34 of the aforementioned exemplary embodiment are projecting runners 39, which are arranged parallel to the moving direction, and via which sliding device 34 lies against front wall 18 when installed. In order to seal first openings 20, and thus the flow path, in as good a way as possible when sliding device 34 is in the closed position, the height of projecting runners 39, that is, the distance between the base surface and the runner surface located at the front side of the individual projecting runner 39, is kept low.

Figure 4:
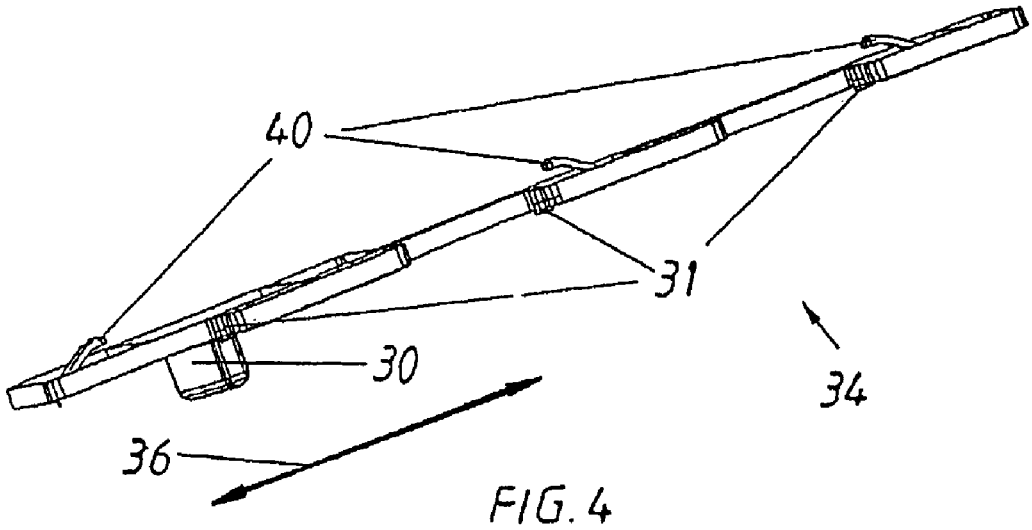
FIG. 4 shows the sliding device of FIG. 3 in a perspective view, looking to a side face.

In FIG. 4, sliding device 34, which is designed as a plate, is shown in a view looking to a side face. Located on the side of sliding device 34 facing away from handle 30 are spring means 40, which are designed as tongues protruding from the plate; spring means 40 running transversely to the plane of motion of sliding device 34.

Figure 5:
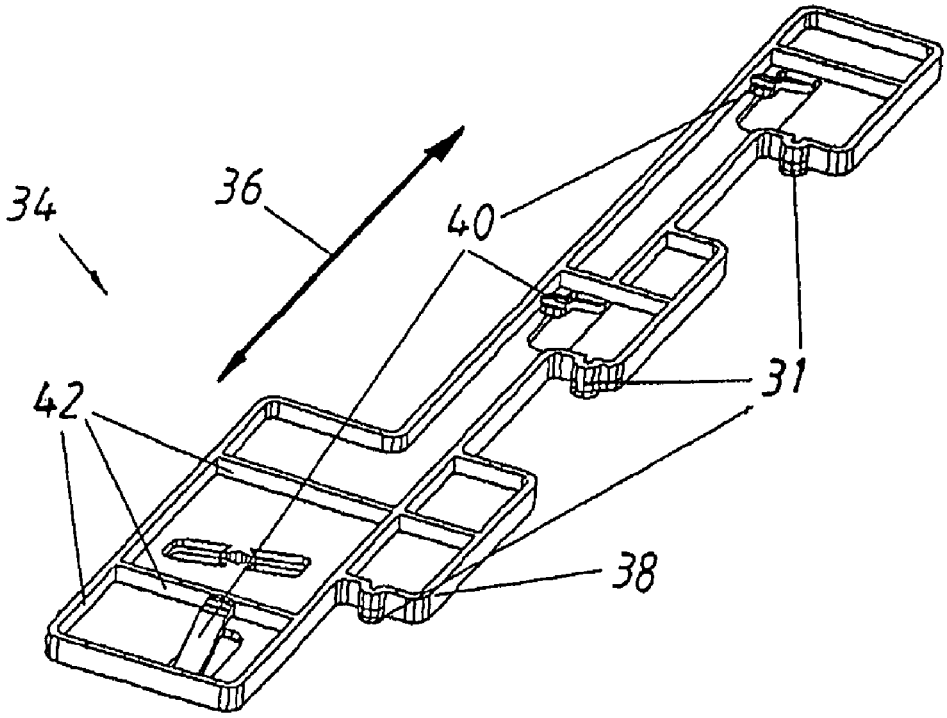
FIG. 5 shows the sliding device of FIG. 3 in a perspective view, looking to the spring means.

FIG. 5 shows sliding device 34 in a view looking to the side facing away from handle 30. As can be inferred from FIG. 5, sliding device 34, which is designed as a plate, has stiffening ribs 42 so that the plate can be manufactured in a material-saving manner while at the same time ensuring torsional rigidity.

The mode of operation will now be explained in more detail with reference to the above exemplary embodiment of the household food warmer according to the present invention, and with reference to FIGS. 1 through 5.

The foods to be kept warm are placed on drawer bottom 16 and/or rack 10 of the household food warmer according to the present invention. Depending on the foods to be kept warm and/or the personal needs of the user, he or she manually moves sliding device 34 to its open position, closed position, or to an intermediate position between the two end positions using handle 30. By way of example, it is assumed here that the user moves sliding device 34 from its closed position to its open position.

Prior to being moved, slide device 34 is in the closed position so that, as shown in FIG. 2, guide means 31 are essentially located at the left end of guides 20, which are formed as longitudinal slots, and which, at the same time, constitute first openings 20. In this context, first openings 20 are covered and thereby closed in a substantially airtight manner by sliding device 34, which is designed as a plate, with its side facing handle 30, to be more precise, with second projections 38. In order to improve the seal of first openings 20, and to ensure reliable guidance of sliding device 34 in guides 20, spring means 40 are arranged on the side facing away from handle 30. When drawer 4 is in the installed state, sliding device 34 is arranged between first outer wall 22 and front wall 18 in such a manner that spring means 40 are preloaded in the installed state. Due to this, sliding device 34, which is designed as a plate, is pressed against front wall 18, resulting in the advantages mentioned above. To achieve a more stable position of sliding device 34, handle 30 is laterally offset from guide means 31 with respect to moving direction 36, so that sliding device 34 is guided, first of all, by guide means 31 engaging in guides 20, as well as by handle 30, which protrudes through third opening 32. For improved stability, moreover, sliding device 34, which is designed as a plate, has spring means 40 arranged on its side facing away from handle 30 and guide means 31; the spring means being located at about half the distance from an imaginary first plane, which extends parallel to moving direction 36 and in which is located the center of handle 30, and a second imaginary plane, which extends parallel to moving direction 36, and in which are located the centers of guide means 31.

When moving sliding device 34 from the closed position to the open position, the user moves sliding device 34 with handle 30 to the top right in the image plane of FIG. 2 along first openings 20, which are formed as longitudinal slots, and third opening 32. In the process, sliding device 34, which is designed as a plate, clears first openings 20, thus opening the flow path between first openings 20 and second opening 28. In the aforementioned exemplary embodiment, sliding device 34 is designed in such a manner that third opening 32 is closed by sliding device 34 in a substantially airtight manner also when the sliding device is in the open position. When sliding device 34 is in the open position, guide means 31 and handle 30 essentially rest against the right end of guides 20, which are formed as longitudinal slots and which at the same time constitute first openings 20, and of third opening 32, respectively.

After adjusting sliding device 34, the user sets the desired keep-warm time using time selector 12, and the desired interior chamber temperature using temperature selector 14, and inserts drawer 4 fully into housing 2 so that the interior chamber is separated from the open environment in a tight manner, except for the flow path between first openings 20 and second opening 28.

Figure 6:
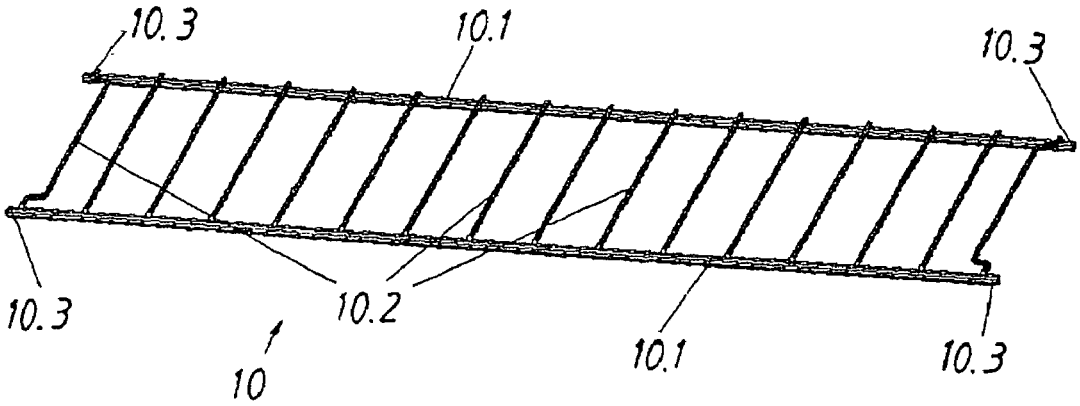
FIG. 6 shows a rack to be arranged in the household food warmer of FIG. 1.

Rack 10 is shown separately in FIG. 6. As can be seen from FIG. 6, rack 10 has two longitudinal bars 10.1, which are arranged parallel to each other, and which carry a plurality of spaced apart cross bars 10.2 running transversely to the longitudinal axis of longitudinal bars 10.1. Longitudinal bars 10.1 are joined to cross bars 10.2 by welding. The ends of the two longitudinal bars 10.1 project beyond the storage area of rack 10, which is bounded by the two outermost cross bars 10.2, so that rack 10 has a second projection 10.3 at both ends of each longitudinal bar 10.1.

As can also be inferred from FIG. 2, drawer 4 has a back wall 44 in addition to drawer bottom 16 and front wall 18. Drawer bottom 16 has bevels 16.1 at its two long edges, the bevels adding stability to drawing bottom 16, and laterally bounding the storage area on top side 8 of drawer bottom 16. Between drawer bottom 16 and front wall 18, as well as between drawer bottom 16 and back wall 44, in each case two stiffening angles 48 are welded on laterally. At the side facing the storage area, back wall 44 of drawer 4 has receptacles 44.1, which are designed as openings. When installed, rack 10 engages in two receptacles 44.1 with second projections 10.3 facing back wall 44. The end of rack 10 facing front wall 18 lies one a first projection 18.1 formed on the side of front wall 18 facing the storage area (see FIG. 2). In the present exemplary embodiment, first projection 18.1 is joined to front wall 18 by welding.

When mounting rack 10, the user can position rack 10 optionally on the left, in the middle, or on the right with respect to the insertion direction of drawer 4. In FIGS. 1 and 2, the arrangement is shown on the left. In this context, rack 10 is first inserted into two receptacles 44.1 with second projections 10.3 facing back wall 44, and subsequently placed on first projection 18.1 with its end facing front wall 18. Rack 10 is dimensioned such that, alternatively, it is also possible to arrange two racks 10 side-by-side, i.e., on the left and on the right.

In a departure from the aforementioned exemplary embodiment, other suitable detachable and permanent joining techniques, known to one skilled in the art are conceivable as well.

In addition to improved ease of use for the user resulting from the possibility of accessing foods and beverages located in the drawer from both sides of the drawer in a barrier-free manner, a particular advantage of the arrangement mentioned above lies in reduced material use during manufacture and in the reduced mass of drawer 4. Due to the reduced mass, the user can move drawer 4 more easily, and the energy used for heating the interior chamber of the household food warmer to a desired temperature is reduced.

Due to the fact that drawer 4 has a back wall 44, the storage area of drawer bottom 16 is bounded at the drawer side facing the back wall of the housing, and a visual screen is accomplished in a simple manner.

By arranging stiffening angles 48 between drawer bottom 16 and front wall 18 and/or back wall 44 of drawer 4, a rugged drawer 4 is made possible regardless of the lack of side walls.

A further advantage of the aforementioned exemplary embodiment is that front wall 18 and back wall 44 of drawer 4 are configured as a holding device for at least one rack 10, which can be arranged in storage area 6. Due to this, it is possible to place dishes at two levels, namely on top side 8 of drawer bottom 16, and on rack 10, while, at the same time, barrier-free access to the dishes placed on drawer bottom 16 is largely maintained because no supporting element, such as a frame, is required for rack 10, which would make lateral access more difficult.

A further advantage of the present exemplary embodiment is that, as a holding device for rack 10, first projection 18.1 is arranged at the side of front wall 18 facing storage area 6, and receptacles 44.1, which are designed as openings, are arranged at the side of back wall 44 facing storage area 6, and that rack 10 is provided with second projections 10.3, which are designed in such a manner that they can engage in receptacles 44.1 Thus, the holding device is accomplished in a particularly simple manner, and rack 10, which is held on drawer 4, is secured against an unwanted change in position.

What is claimed is:

1. A household food warmer comprising:

a housing including an interior chamber;

a drawer configured to be received by the interior chamber, the drawer including a drawer bottom and a front wall having a first opening configured to provide an air flow path between the interior ehamber and an exterior of the housing; and a sliding device configured to close the first opening in a substantially airtight manner, the sliding device including a handle and including a guide device configured to engage the front wall in a guide at the front wall, the sliding device being a single piece;

wherein the sliding device further includes a spring device, the spring device running transversely to a plane of motion of the sliding device.

2. The household food warmer as reeited in claim 1 wherein the sliding device includes a plastic material.

3. The household food warmer as recited in claim 1 wherein the guide includes a longitudinal groove or slot, and the guide device includes a first projection.

4. The household food warmer as recited in claim 1 wherein the drawer further includes at least one outer wall having a second opening so as to form a flow path between the first and second openings, a first outer wall of the at least one outer wall being disposed substantially parallel to the front wall, the sliding device being disposed between the front wall and the first outer wall, the sliding device being configured to close the flow path between the first and second openings in a substantially airtight manner.

5. The household food warmer as recited in claim 4 wherein the drawer further includes a partition configured to divide a space bounded by the front wall and the at least one outer wall into a first region and a second region in a substantially tight manner, the flow path being disposed in the first region.

6. The household food warmer as recited in claim 5 wherein the front wall further includes a third opening disposed adjacent the first region, the handle protruding through the third opening.

7. The household food warmer as recited in claim 1 wherein the drawer further includes at least one outer wall having a second opening so as to form a flow path between the first and second openings, a first outer wall of the at least one outer wall being disposed substantially parallel to the front wall, the sliding device being disposed between the front wall and the first outer wall, the sliding device including a plate having a second projection extending transversely to a moving direction of the plate, the second projection being configured to close the first opening so as to close the flow path between the first and second openings in a substantially airtight manner.

8. A household food warmer comprising:

a housing including an interior chamber;

a drawer configured to be received by the interior chamber, the drawer including a drawer bottom and a front wall having a first opening configured to provide an air flow path between the interior chamber and an exterior of the housing;

a sliding device configured to close the first opening in a substantially airtight manner, the sliding device including a handle and including a guide device configured to engage the front wall in a guide at the front wall, the sliding device being a single piece; and a spring device disposed on the sliding device, the spring device running transversely to a plane of motion of the sliding device.

9. The household food warmer as recited in claim 1 wherein the sliding device includes a plate, and the spring device includes a tongue protruding from the plate.

10. A household food warmer comprising:

a housing including an interior chamber;

a drawer configured to be received by the interior chamber, the drawer including a drawer bottom and a front wall having a first opening configured to provide an air flow path between the interior chamber and an exterior of the housing; and a sliding device configured to close the first opening in a substantially airtight manner, the sliding device including a handle and including a guide device configured to engage the front wall in the first opening, the sliding device being a single piece;

wherein the sliding device further includes a spring device, the spring device running transversely to a plane of motion of the sliding device.

11. The household food wanner as recited in claim 10 wherein the sliding device includes a plate, and the spring device includes a tongue protruding from the plate.

* * * * *